US005138827A

United States Patent [19]

Müller

[11] Patent Number: 5,138,827

[45] Date of Patent: Aug. 18, 1992

[54] SERVICE UNIT FOR GROUPWISE EXCHANGE OF BOBBINS BETWEEN A CREEL AND A BANK OF A TEXTILE FLY FRAME

[75] Inventor: Heinz Müller, Sparwiesen, Fed. Rep. of Germany

[73] Assignee: Zinser Textilmaschinen GmbH, Ebersbach/Fils, Fed. Rep. of Germany

[21] Appl. No.: 499,001

[22] Filed: Mar. 23, 1990

[30] Foreign Application Priority Data

Mar. 23, 1989 [DE] Fed. Rep. of Germany ..... 3909723

[51] Int. Cl.[5] ..... D01H 9/10; D01H 9/00; D01H 9/14

[52] U.S. Cl. ..... 57/270; 57/276; 57/281

[58] Field of Search ..... 57/266, 267, 268, 270, 57/274, 275, 276, 281, 90

[56] References Cited

U.S. PATENT DOCUMENTS

| | | | |
|---|---|---|---|
| 3,380,238 | 9/1966 | Araki et al. | 57/267 |
| 3,935,699 | 2/1976 | Iida et al. | 57/267 |
| 4,051,652 | 10/1977 | Hirano et al. | 57/270 |
| 4,473,997 | 10/1984 | Kawasaki et al. | 57/281 X |
| 4,757,679 | 7/1988 | Marzoli | 57/267 |
| 4,799,353 | 1/1989 | Kawasaki et al. | 57/268 X |
| 4,805,353 | 2/1989 | Grassle et al. | 57/267 |

*Primary Examiner*—Daniel P. Stodola
*Assistant Examiner*—Michael P. Mansen
*Attorney, Agent, or Firm*—Shefte, Pinckney & Sawyer

[57] ABSTRACT

A traveling service unit for groupwise exchange of bobbins supported on a creel above the service unit for bobbins supported on the bank of a textile fly frame. The traveling service unit includes a gripper assembly having gripper components for releasably individually gripping bobbins and supported relative to one another in two parallel gripper rows and a peg support assembly having a pair of movable portions, each portion having two parallel rows of pegs for supporting bobbins thereon. The traveling service unit further includes a device for selectively adjusting the spacing of the gripper components within each gripper row relative to one another and a device for selectively adjusting the spacing between the parallel rows of each portion of the peg support device. Accordingly, the traveling service unit is operable to exchange bobbins between a creel and a bobbin bank in which the two rows of creel pegs have a different spacing within each row and a different spacing between the rows than the pegs of the bobbin bank.

21 Claims, 4 Drawing Sheets

SERVICE UNIT FOR GROUPWISE EXCHANGE OF BOBBINS BETWEEN A CREEL AND A BANK OF A TEXTILE FLY FRAME

BACKGROUND OF THE INVENTION

The present invention relates to a service unit for groupwise exchange of bobbins between a creel and a bank of a textile fly frame.

In U.S. Pat. No. 4,805,352 to Grassle et al., an apparatus is disclosed for exchanging full bobbins on a bobbin bank of a textile fly frame for empty bobbins. The apparatus includes a pivotable gripper assembly mounted to a traveling surface unit, a revolving plate means having a plurality of pegs for receiving bobbins thereon and means for raising and lowering the plate pegs to transfer bobbins between the plate pegs and a creel extending overhead the traveling service unit along its direction of travel. The full bobbins on the bobbin bank of the textile fly frame are arranged in two parallel rows and are uniformly spaced from one another along each row. The creel includes two parallel banks for supporting two parallel rows of empty bobbins in reserve and the empty bobbins are uniformly spaced with one another within each creel row. The gripper assembly is operable to simultaneously transfer a plurality of full bobbins from each of the parallel rows of the bobbin bank to two parallel rows of plate pegs on the plate means in the traveling service unit.

The raising and lowering means of the traveling service unit is operable to raise another pair of parallel rows of plate pegs toward the creel to receive a plurality of empty bobbins from each creel row and to return the thus-loaded plate pegs to the plate means. Thereafter, the plate means is revolved generally 180°. The gripper assembly then grips the parallel rows of empty bobbins supported on the plate pegs to transfer these empty bobbins to the bobbin bank while the raising and lowering means raises the plate pegs with full bobbins thereon toward the creel to transfer these bobbins to the creel rows.

The uniform spacing of the full bobbins of each bobbin bank row typically is different than the uniform spacing of the empty bobbins in each creel row. Additionally, the transfer spacing between the two parallel bobbin rows typically is different than the transverse spacing between the two parallel creel rows. Accordingly, the linear spacing between the bobbins within each row and the transverse spacing between each pair of parallel bobbin rows must be adjusted as the bobbins are transferred between the creel and the bobbin bank. The Grassle et al patent discloses a parallelogram linkage for effecting such adjustments simultaneously. However, the need exists for an apparatus which relatively rapidly effects such adjustments independently to improve the efficiency of the bobbin exchange operation of a textile fly frame.

SUMMARY OF THE INVENTION

The present invention provides a traveling service unit which permits relatively rapid groupwise exchange of bobbins between a creel and a bobbin bank of a textile fly frame.

Briefly described, the present invention provides a traveling service unit for groupwise exchange of a plurality of bobbins supported on a creel above the service unit for a plurality of bobbins supported on a bank of a fly frame, the creel having a pair of rows of pegs uniformly spaced along each row, the creel peg rows extending parallel to one another at a predetermined spacing and each peg being capable of individually supporting a bobbin thereon, the bank having a pair of rows of pegs, the bank peg rows extending parallel to one another at a predetermined spacing different than the predetermined spacing of the creel peg rows and the pegs of the bank each being capable of individually supporting a bobbin thereon and being uniformly spaced along each respective bank peg row at a uniform spacing different than the uniform spacing between the pegs in each creel peg row. The traveling service unit includes a gripper assembly including a plurality of gripper components for releasably gripping a bobbin by each gripper component, the gripper components being supported relative to one another in two parallel gripper rows and peg support means. The peg support means include a first movable portion and a second movable portion, each portion having two parallel rows of pegs thereon for supporting bobbins, and the pegs of each row being at a uniform spacing from one another substantially equal to the uniform spacing between the pegs of each bank peg row.

Additionally, the traveling service unit preferably includes means for selectively adjusting the spacing of the gripper components within each gripper row relative to one another between between a spacing substantially equal to the spacing of pegs in the creel peg rows and in alignment for transfer of bobbins therebetween and a spacing substantially equal to the spacing between pegs in the peg support means rows and in alignment for transfer of bobbins therebetween. The traveling service unit further preferably includes means for selectively moving the gripper assembly between a disposition adjacent the bank for transferring bobbins between the respective gripper components and the bank, and a disposition adjacent the peg support means for transferring bobbins between the respective gripper components and the peg support means. Moreover, the preferred embodiment of the traveling service unit includes means for selectively adjusting the spacing between the parallel rows of each peg support means portion between a spacing substantially equal to the spacing of the creel peg rows and in alignment for transfer of bobbins therebetween and a spacing substantially equal to the spacing between the bank peg rows and in alignment for transfer of bobbins therebetween.

The preferred embodiment further includes means for selectively raising and lowering the peg support means portions individually between a raised position for transfer of bobbins between the portion and the creel and a lowered position for movement into position for transfer of bobbins between the portion and the gripper assembly. Finally, the preferred embodiment of the traveling service unit includes means for moving the peg support means to alternately position each of the peg support means portions for transfer of bobbins between the gripper assembly and the peg support means portion and position the other portion for raising toward the creel for transfer of bobbins therebetween.

According to one aspect of the present invention, the gripper component spacing adjusting means adjusts the spacing of the gripper components within each gripper row relative to one another longitudinally of the gripper row and the means for adjusting the spacing between the peg support means portions adjusts the spacing between the parallel rows of each peg support means portion transversely of the peg support means portion rows. Preferably, the peg support means moving means includes means for revolving the peg support means portions about an axis of revolution to effect the alternately positioning of the peg support means portions. The axis of revolution is preferably a vertical axis.

According to a further aspect of the preferred embodiment of the present invention, the gripper component spacing adjusting means includes means interconnecting each gripper component of one of the gripper rows with a corresponding gripper component of the other of the gripper rows for coordinated longitudinal movement of interconnected gripper components toward and away from each other. The interconnecting means preferably includes an endless belt having a longitudinal reach to which one gripper component of one of the gripper rows is secured and an opposite longitudinal reach to which the corresponding gripper component of the other of the gripper rows is secured. Additionally, means for reciprocating the endless belt to effect movement of the gripper components toward and away from each other is provided.

According to an additional aspect of the present invention, a longitudinal slide bar for slidably guiding the gripper components during movement of the gripper components toward and away from each other is provided. In yet another aspect of the present invention, the gripper assembly has a longitudinal midpoint and the gripper components of each interconnected pair of the gripper components are equally spaced from the longitudinal midpoint for simultaneous equal movement of the gripper components of each the interconnected pair of gripper components toward and away from each other. The interconnecting means preferably moves the pairs of gripper components, proportionally relative to their spacing from the longitudinal midpoint to maintain equal spacing between the gripper components in each row.

In the preferred embodiment, the interconnecting means includes a plurality of endless belts, each endless belt having one longitudinal reach to which one gripper component in the one row of the gripper rows is secured and an opposite longitudinal reach to which the other gripper component in the other of the gripper rows is secured. Additionally, the preferred embodiment includes a plurality of means for reciprocating the endless belts to effect movement of the gripper components toward and away from each other, each reciprocating means being connected to one of the gripper components for moving the gripper component, associated belt and corresponding gripper component to thereby effect movement of the gripper components toward and away from each other. The reciprocating means is preferably a cylinder and piston assembly, the piston being connected to one of the gripper components.

According to a further aspect of the present invention, the means for selectively adjusting the peg row spacing moves one of the parallel rows of each the peg support means portion laterally relative to the other of the parallel rows. Additionally, the peg support means supports the peg support means portions in a disposition in which one row of pegs of each portion is adjacent one row of pegs of the other portion and the other row of pegs of each portion is laterally outward of the adjacent row of pegs. The means for selectively adjusting the peg row spacing moves the laterally outer one of the parallel rows of each peg support means portion relative to the other of the parallel rows.

According to yet a further aspect of the present invention, slide means for supporting the laterally outer parallel row of each peg support means portion for lateral sliding movement thereof is provided. Furthermore, the traveling service unit also includes a revolution plate and means for pivotally mounting the revolution plate to the traveling service unit for rotation about an axis of revolution, the laterally inner ones of the parallel rows of the peg support means portions being supported on the revolution plate. The movable parallel rows of pegs of the peg support means portions are interconnected to one another for coordinated movement of the movable parallel rows of pegs relative to the other parallel rows of pegs of the peg support means portions. The coordinated movement interconnecting means effects movement of the movable parallel row of one peg support means portion toward the other parallel row of the one peg support means portion while simultaneously moving the movable parallel row of the other peg support means portion away from the other parallel row of the other peg support means portion.

In the preferred embodiment of the present invention, the peg support means preferably includes a revolution plate and means for pivotally mounting the revolution plate to the traveling service unit for revolving movement of the revolution plate about an axis of revolution, means for supporting one of the parallel rows of each of the peg support means portions on the revolution plate, and a pair of laterally movable plates disposed laterally outward of the revolution plate and connected thereto for revolving movement therewith, each other row of pegs of the pairs of rows of the peg support means portions being mounted on one of the outer plates. Additionally, the peg support means includes an annular cam mounted to the traveling service unit with its axis offset from the revolution axis, cam follower means for following the annular cam, connecting link means for movably coupling the cam follower means to each of the laterally movable peg support plates for alternately moving each of the laterally movable plates toward and away from the revolution plate in correspondence with the cam following movement of the cam follower means along the annular cam during revolving movement of the revolution plate. Preferably, each of the parallel rows of each of the peg support means portions includes three pegs, and each of the rows of gripper components includes three gripper components.

DETAILED DESCRIPTION OF THE PREFERRED EMBODIMENT

Figure 1:
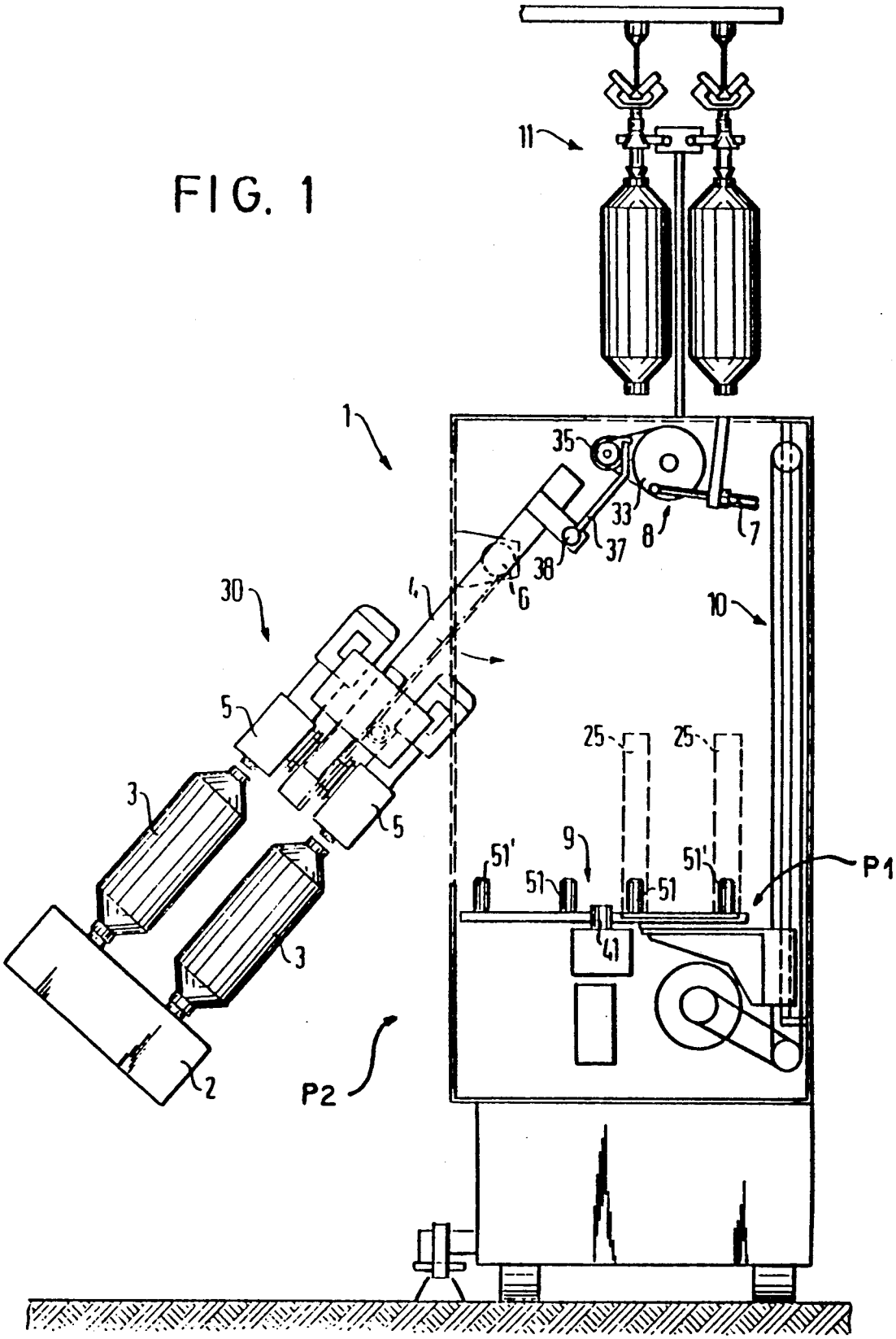
FIG. 1 is a front elevational schematic view of a creel and bobbin bank of a textile fly frame and the preferred embodiment of the traveling service unit of the present invention for exchanging bobbins between the creel and the bobbin bank.

The preferred embodiment of the traveling service unit of the present invention as illustrated in the drawings is generally designated as 1 and is used with a textile fly frame that includes a bobbin bank 2 and a creel 11. The bobbin bank 2 supports two parallel rows of bobbins 3 onto which roving is built by flyer devices (not shown) and the bobbin bank is movable in conventional manner from a bobbin building disposition in which the bobbin bank is essentially horizontal for supporting the bobbins 3 in generally vertical dispositions and a tilted disposition in which the bobbins 3 are inclined in an orientation for engagement by the traveling service unit 1 during a bobbin exchange operation.

The creel 11 includes two parallel banks, each bank supporting a plurality of bobbins thereon. The banks of the creel 11 extend parallel to the direction of travel of the traveling service unit 1 longitudinally along the side of the textile fly frame and each bank is initially loaded with a row of empty bobbins 25 at a uniform spacing from each other within each row. As bobbin exchange operations are executed, each bank supports a row of full bobbins 3 transferred thereto by the traveling service unit 1 during the bobbin exchange operations.

The traveling service unit 1 includes conventional wheel assemblies for rolling travel longitudinally along the textile fly frame parallel to the bobbin bank 2 for repetitively executing bobbin exchange operations to exchange the full bobbins 3 on the bobbin bank 2 for the empty bobbins 25 supported on the banks of the creel 11. The traveling service unit 1 includes a gripper assembly 30 having a plurality of conventional gripper components 5 for releasably gripping a bobbin. The gripper components 5 are movably secured to an arm means 4. The arm means 4, as best seen in FIG. 3, includes a first arm member 4' pivotally connected to the housing of the traveling service unit 1 by a pivot means 6 and a second arm member 4" pivotally connected to the housing of the traveling service unit 1 by another pivot means 6 and the pair of pivot means 6 are coaxial with one another for permitting pivoting of the arm members 4', 4" about a common axis in one direction as shown by the arrow in FIG. 1 and in an opposite direction as shown by the arrow in FIG. 2. Each arm member 4', 4" supports a cylindrical shaft 13. As seen in FIG. 2, the traveling service unit includes a pair of longitudinal slide bar members !5 extending transversely to the cylindrical shafts 13. Each bar member 15 is fixedly mounted at each respective end to a bracket 12. As seen in FIG. 3, the bracket 12 is slidably coupled to each of the cylindrical shafts 13 for sliding movement therealong to effect translational movement of the longitudinal slide bar members 15. Each of the gripper components 5 is slidably connected to one of the pair of longitudinal slide bar members 15 for sliding movement along the respective longitudinal bar member.

As seen in FIG. 2, a drive motor 21 is mounted to the bracket 12 for driving rotation of a pinion 23 rotatably mounted by a shaft 22 to the bracket 12. The arm member 4" is provided with a rack 20 along one longitudinal surface thereof for meshing engagement with the pinion 23. Accordingly, the drive motor 21 is operable to drive the pinion 23 along the rack 20 to effect movement of the bracket 12 along the cylindrical shafts 13 to thereby selectively translationally move the longitudinal slide bar members 15 relative to the arm means 4.

The traveling service unit 1 additionally includes a means 8 for pivoting the arm means 4 about the common axis of the pivot means 6. The means 8 includes a conventional cylinder and piston assembly 7 fixedly mounted to the housing of the traveling service unit 1. The free end of the piston of the cylinder and piston assembly 7 is pivotally mounted to a drive pulley 33 which is pivotally mounted to the housing of the traveling service unit 1. A driven pulley 35 pivotally mounted to the traveling service unit housing is drivingly connected by an endless belt 34 to the drive pulley 33. A lever 36 is fixedly mounted to the driven pulley 35 for rotation therewith and the free end of the lever 36 is pivotally connected to one free end of a link member 37. The other free end of the link member 37 is pivotally connected by a pivot 38 to the arm means 4.

Figure 2:
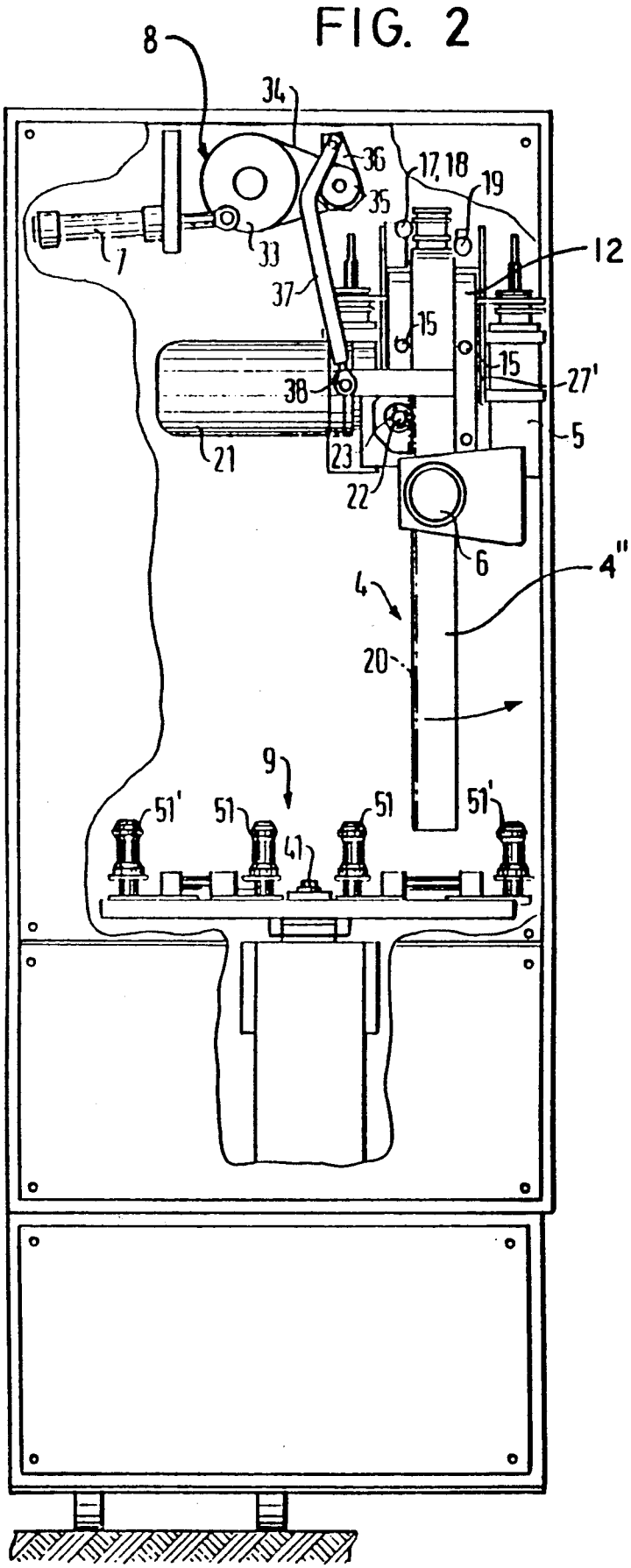
FIG. 2 is a rear elevational schematic view of the traveling service unit shown in FIG. 1 with the housing partially broken away.
Figure 3:
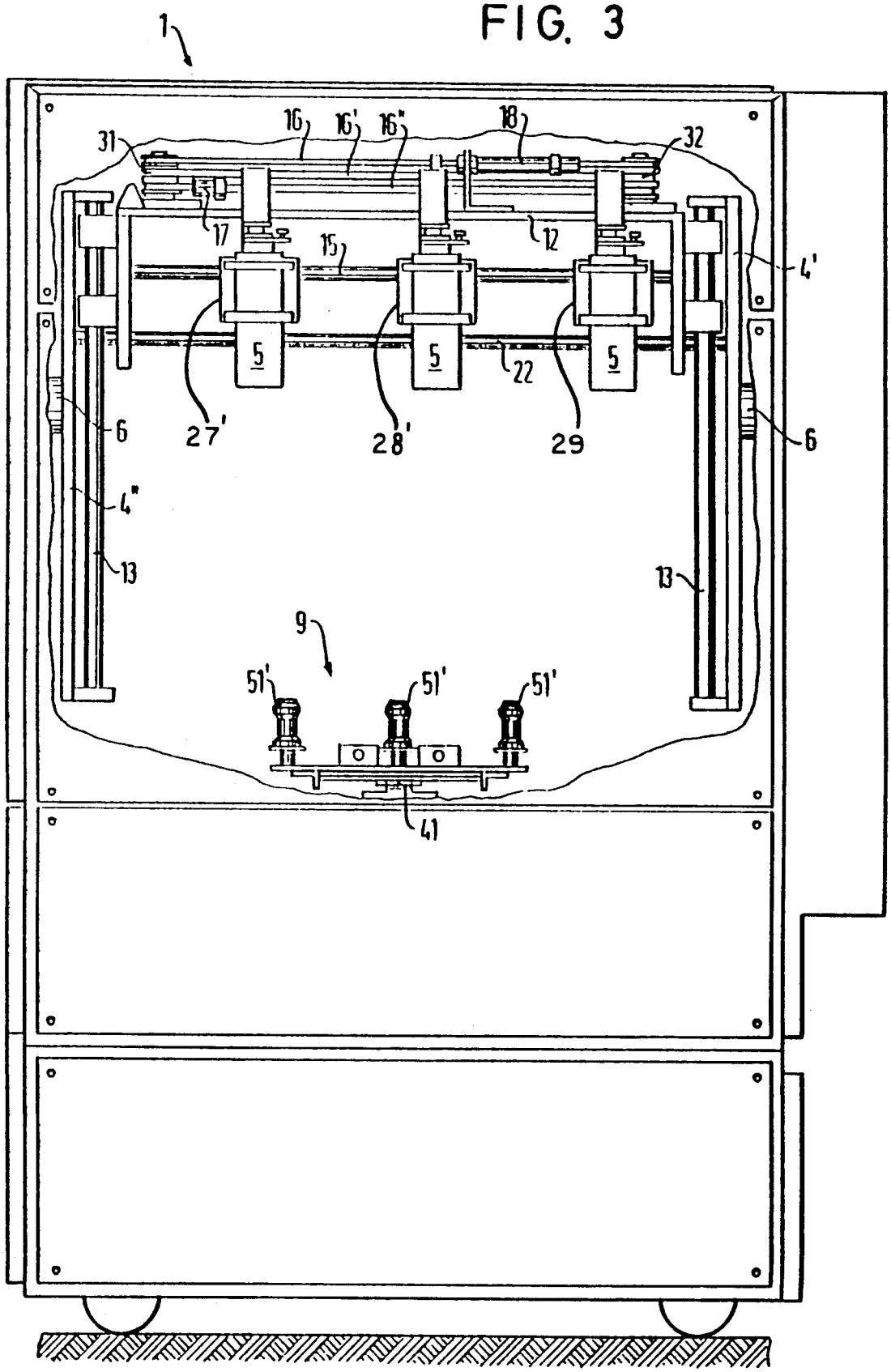
FIG. 3 is a side elevational view of the traveling service unit shown in FIG. 1 with the housing partially broken away.

As seen in FIGS. 1 and 2, the piston of the cylinder and piston assembly 7 is selectively extendable and retractable to effect rotation of the drive pulley 33. The rotation of the drive pulley 33 is drivingly transmitted by the endless belt 34 to the driven pulley 35 for rotation thereof. The rotation of the driven pulley 35 effects pivoting movement of the free end of the lever 36 about the axis of the driven pulley 35, thereby driving the link member 37. The driving movement of the link member 37 is transmitted via the pivot 38 to the arm means 4 to effect pivoting of the arm means 4 about the common axis of the pivot means 6. Accordingly, the means 8 pivots the arm means 4 between the position shown in FIG. 1 in which the gripper components 5 of the gripper assembly 30 can be moved by driving rotation of the pinion 23 along the rack 20, into gripping engagement with the full bobbins 3, and the position shown in FIG. 2 in which the arm members 4', 4" are generally vertical.

Figure 5:
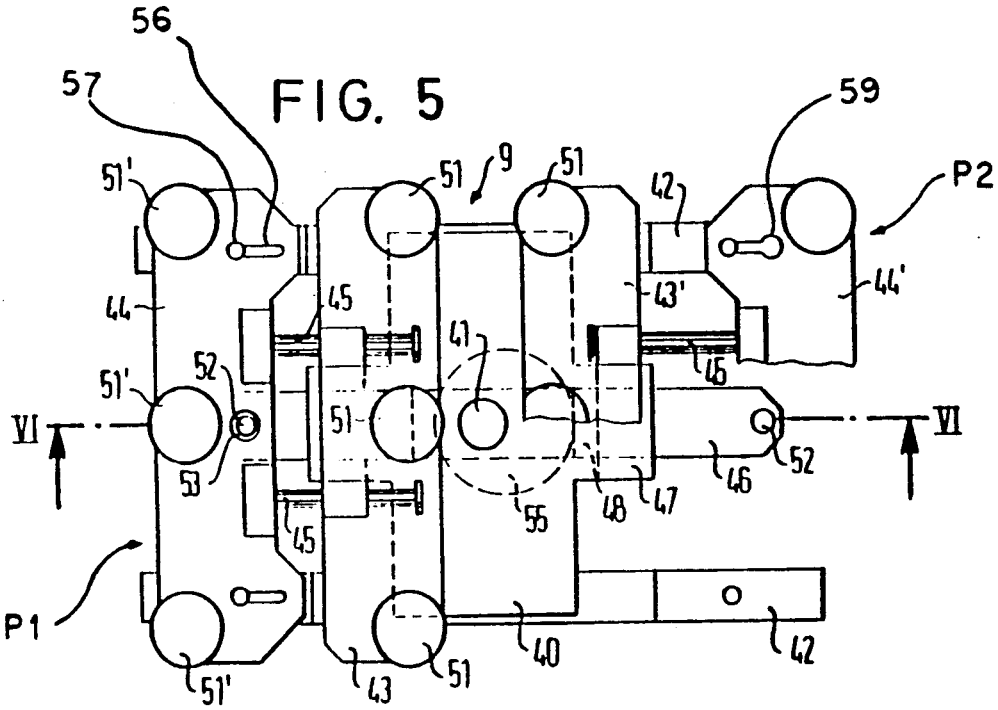
FIG. 5 is a partial plan view of the peg support means portion spacing adjusting means of the traveling service unit shown in FIG. 3.

The traveling service unit 1 additionally includes peg support means 9 having a first movable portion P1 and a second movable portion P2, each portion P1, P2 having two parallel rows of pegs 51, 51' thereon for supporting bobbins. As seen in FIG. 5, each row of pegs 51, 51' is at a uniform spacing from one another and the uniform spacing of the pegs is substantially equal to the uniform spacing between the pegs of each bobbin bank row of the bobbin bank 2. The peg support means 9 includes a revolution plate 40 coupled by a connector 41 to the frame of the traveling service unit 1 for revolving movement of the revolution plate 40 about a vertical axis of revolution. Each peg support means portion P1, P2 includes an inner peg support plate 43, 43', respectively, for supporting a respective row of the pegs 51 on the revolution plate 40, as best seen in FIGS. 5 and 6.

Figure 6:
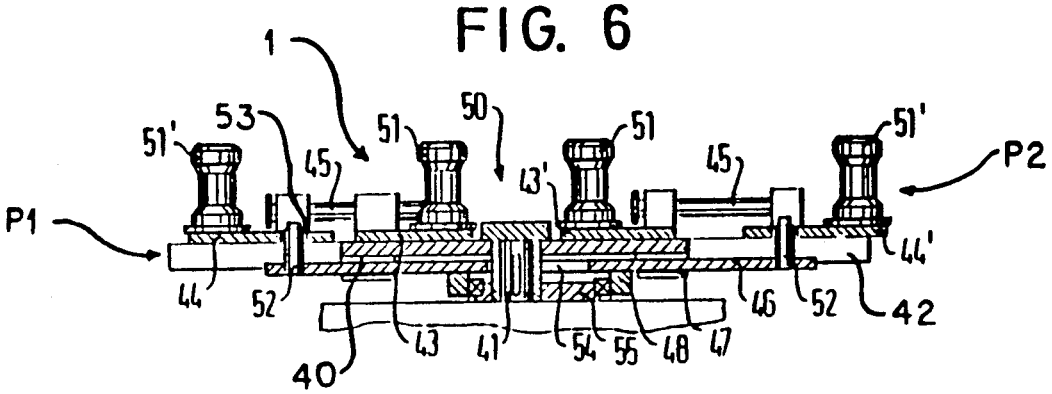
FIG. 6 is a side elevational view in partial section of the peg support means portion spacing adjusting means shown in FIG. 5, taken along lines VI—VI thereof.

As best seen in FIGS. 5 and 6, the peg support means 9 additionally includes an annular cam 55 fixedly mounted to the frame of the traveling service unit 1 with its axis parallel to and offset from the vertical axis of revolution of the revolution plate 40. A connecting link 46 includes a central throughbore 54 for receiving the connector 41 therethrough. A cam follower means 48 in the form of an annular ring is fixedly mounted to the underside of the connecting link 46 coaxial with its central bore 54 and the cam follower means 48 is rotatably mounted by a conventional annular bearing assembly on the annular cam 55 for cam following movement of the cam follower means 48 about the annular cam 55. The connecting link 46 is slidably received in a pair of brackets 47 mounted to the underside of the revolution plate 40.

Each peg support means portion P1, P2 also includes a laterally outer peg support plate 44 on which the respective row of the pegs 51' are mounted. Each laterally outer peg support plate 44 is fixedly connected to a pair of sliding shaft means 45. Each pair of the sliding shaft means 45 is slidably secured to the respective inner peg support peg support plate 43, 43' associated with each laterally outer peg support plate 44 for sliding movement of the sliding shaft means 45 relative to the associated inner peg support plate. A pair of lateral support members 42 are fixedly mounted to the underside of the revolution plate 40 adjacent opposite ends thereof and each lateral support member 42 includes a slot pin 57 projecting upwardly therefrom adjacent each respective end of the lateral support member. Each laterally outer peg support plate 44, 44' includes a pair of slots 56 for slidable receiving a slot pin 57 mounted to one of the lateral support members 42 therein. Accordingly, the sliding shaft means 45, the slots 56 and the slot pins 57 slidably guide the laterally outer peg support plates 44, 43 along predetermined lateral travel paths during sliding lateral movement of the plates relative to the inner peg support plates 43, 43', respectively.

Each laterally outer peg support plate 44, 44' includes a throughbore 53. The connecting link 46 includes a pair of pins 52 each mounted adjacent a respective free end thereof and being movably received in a respective throughbore 53 of the laterally outer peg support plates 44, 44'.

As best seen in FIG. 6, the respective laterally outer peg support plate 44, 44', inner peg support peg support plate 43 and pair of sliding shaft means 45 of each peg support means portion P1, P2 is supported on the revolution plate 40 and the lateral support member 42 as an integral unit for revolution together and is vertically movable therefrom by a vertical movement assembly 10, shown in FIG. 1. Each inner peg support peg support plate 43 is normally supported on the revolution plate 40 and each laterally outer peg support plate 44, 44' is normally supported on the lateral support members 42 with a pair of slot pins 57 thereof being received in the slots 56 of the outer peg support plate and one of the pins 52 being received in the throughbore 53 of the outer peg support plate.

The vertical movement assembly 10 is conventional and may comprise, for example, an endless belt device having a support flange for engaging and supporting one of the portions P1, P2 during vertical movement of the support flange by the endless belt device. To permit relative movement of each slot 56 of each outer peg support plate 44, 44' beyond the respective slot pin 52 projecting therein, each slot 56 includes an enlarged portion 59, shown in FIG. 5.

Figure 4:
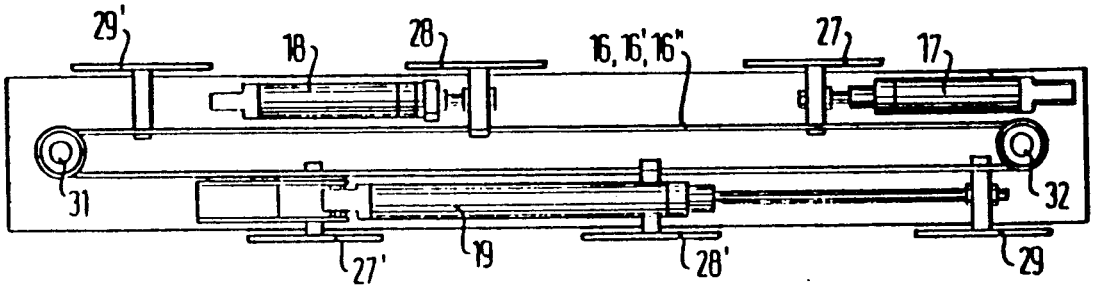
FIG. 4 is a plan view of a portion of the gripper component spacing adjusting means of the traveling service unit shown in FIG. 3.

As seen in FIGS. 3 and 4, a means for selectively adjusting the spacing of the gripper components 5 within each gripper row relative to one another includes means for interconnecting each gripper component 5 of one gripper row with a gripper component of the other gripper row for coordinated longitudinal movement of the gripper components toward and away from each other. The interconnecting means includes a plurality of endless belts 16, 16' and 16" commonly trained around a pair of spaced guide rollers 31, 32 in vertically superposed relation with each other. Each endless belt 16, 16', 16" has one longitudinal reach on which one gripper component is secured and an opposite longitudinal reach on which another gripper component is secured. Specifically, a gripper component mounting means 29' is fixedly secured to one longitudinal reach of the endless belt 16' for mounting one of the gripper components 5 and another gripper component mounting means 29 is fixedly secured to the other longitudinal reach of the endless belt 16' for mounting another gripper component 5 to the endless belt. A gripper component mounting means 28 is fixedly secured to the endless belt 16 on one longitudinal reach thereof and another gripper component mounting the endless belt 16. A gripper component mounting means 27 is fixedly secured to one longitudinal reach of the endless belt 16" and another gripper component mounting means 27' is fixedly secured to the opposite longitudinal reach of the endless belt 16".

As seen in FIG. 4, a means for reciprocating the endless belts to effect movement of the gripper components toward and away from each other includes a plurality of cylinder and piston assemblies 17, 18 and 19. Each cylinder of each cylinder and piston assembly 17, 18, 19 is mounted to the movable bracket 12. The free end of the piston of the cylinder and piston assembly 17 is connected to the gripper component mounting means 27, the free end of the piston of the cylinder and piston assembly 18 is connected to the gripper component mounting means 28 and the free end of the piston of the cylinder and piston assembly 19 is connected to the gripper component mounting means 29. The pistons of the cylinder and piston assemblies 17, 18 and 19 are selectively extendable and retractable relative to their associated cylinder for effecting movement of each respective pair of gripper component mounting means of each endless belt toward and away from one another to thereby selectively adjust the spacing of the gripper components 5 of each gripper row.

The operations of the cylinder and piston assemblies 17, 18 and 19 are coordinated to effect coordinated movement of the gripper components 5 of each gripper row. Specifically, the movement of the gripper components 5 is coordinated such that the gripper components are moved from a first disposition in which each gripper component of each gripper row is spaced from the next adjacent gripper component at a uniform spacing substantially equal to the uniform spacing of the bobbins on the bobbin bank 2 and a second disposition in which each gripper component 5 of each gripper row is spaced from the next adjacent gripper component by a uniform spacing substantially equal to the spacing of the pegs 51, 51' in their respective rows on the peg support means portions P1, P2. In this regard, the uniform spacing of the pegs 51, 51' within each row corresponds to the uniform spacing between the conventional bobbin support devices of each creel row.

As can be understood, the adjustment of the gripper components 5 of each gripper row between their two respective spacing dispositions is accomplished by selectively extending the pistons of some of the cylinder and piston assemblies 17, 18 and 19 while retracting the pistons of other of the cylinder and piston assemblies proportionally relative to their spacing from the longitudinal midpoint of the gripper assembly to maintain equal spacing between the gripper components 5 in each gripper row. In this regard, the longitudinally outermost gripper components 5, such as the pair of gripper components 5 mounted on the mounting components 29, 29', are moved in relatively larger longitudinal strokes than the longitudinally inner gripper components 5 on the mounting components 28, 28'. Accordingly, the piston assembly 19 associated with the mounting component 29 has a longer piston stroke than the piston assembly 18 associated with the mounting component 28.

To position the gripper components 5 in their spacing disposition for gripping the full bobbins 3 on the bobbin bank 2, the piston of the cylinder and piston assembly 17 is retracted to effect movement of the pair of gripper components 5 mounted on the gripper component mounting means 27, 27' (which are interconnected by the endless belt 16'), away from one another. Additionally, the piston of the cylinder and piston assembly 19 is extended from the cylinder to effect movement of the gripper components mounted on the gripper component mounting means 29, 29' (which are interconnected by the endless belt 16'') away from one another. This spacing disposition of the gripper components 5 is illustrated in FIG. 4. To effect movement of the gripper components 5 from their spacing disposition illustrated in FIG. 4 to their spacing disposition for transferring bobbins to the peg support means 9, the piston of the cylinder and piston assembly 17 is extended from the cylinder to effect movement of the gripper components 5 mounted on the mounting components 27, 27' toward one another and the piston of the cylinder and piston assembly 19 is retracted into the cylinder to effect movement of the gripper components 5 mounted on the gripper component mounting means 29, 29' toward one another. Additionally, the piston of the cylinder and piston assembly 18 is selectively extended or retracted to effect movement of the gripper components 5 mounted on the gripper component mounting means 28, 28' to effect uniform spacing of the gripper components 5 in their spacing disposition for transfer of bobbins to the peg support means 9.

In operation, the traveling service unit 1 is positioned adjacent a portion of the bobbin bank 2 on which a plurality of full bobbins 3 are ready to be exchanged for empty bobbins. The means 8 is operated to pivot the arm means 4 about the axis of the pivot means 6 and the gripper assembly 30 is moved relative to the arm means 4 via driving rotation of the pinion 23 along the rack 20 to move the gripper components 5 into position for engagement of the full bobbins 3, as shown in FIG. 1. The gripper components 5 are disposed in their first spacing disposition in which they are uniformly spaced in their respective gripper row at a uniform spacing substantially equal to the uniform spacing of the full bobbins 3 in each of the bobbin bank rows. The gripper components 5 are then conventionally operated to grip the plurality of full bobbins 3.

In coordination with the movement of the gripper assembly 30 to grip the full bobbins 3, the vertical movement assembly 10 is operated to raise the one of the peg support means portions P1, P2 which is positioned thereover toward the creel 11 for transfer of a plurality of empty bobbins 25 supported on the two creel rows to the pegs 51, 51' of the raised peg support means portion. Due to the operation of the peg support means 9 as more fully explained below, the transverse spacing between the row of pegs 51 and the row of pegs 51' of the raised peg support means portion is adjusted to be substantially equal to the transverse spacing between the creel rows of the creel 11 so that each row of the pegs 51, 51' is aligned with a respective row of the empty bobbins 25 supported on the creel 11. Once the plurality of empty bobbins 25 have been transferred to the raised peg support means portion, the vertical movement assembly 10 moves the raised peg support means portion downwardly to its supported position on the revolution plate 40 and the lateral support member 42.

Once the gripper assembly 30 has gripped the plurality of full bobbins 3 to be exchanged, the means 8 is activated to pivot the arm means 4 in the direction shown by the arrow in FIG. 1 to dispose the gripper components 5 in their vertical disposition with the full bobbins 3 supported therebeneath. In conjunction with this pivoting movement of the arm means 4, the pinion 23 is operated to move the gripper assembly 30 upwardly relative to the arm means 4 to provide clearance between the bottom of the full bobbins 3 and the pegs 51, 51' of the given peg support means portion (e.g., the peg support means portion P2 shown in FIG. 1 to which the full bobbins 3 will be transferred).

The pegs 51, 51' of the peg support means portion P2 to which the full bobbins 3 will be transferred are at a uniform spacing from each other in each row which corresponds to the spacing of the empty bobbins on the creel rows of the creel 11. The spacing of the empty bobbins within each creel row is different than the spacing of the full bobbins 3 within each bobbin bank row. Accordingly, the means for selectively adjusting the spacing of the gripper components is operated to adjust the spacing of the gripper components 5 in each gripper row for aligning the full bobbins 3 with the underlying pegs 51, 51'. In this regard, the cylinder and piston assemblies 17, 18 and 19 are operated as described above to move the interconnected gripper components 5 selectively toward and away from one another to move the gripper components between their spacing disposition for engaging the full bobbins 3 on the bobbin bank 2 and their spacing disposition for transferring the full bobbins to the peg support means 9.

Following the adjustment of the spacing of the gripper components 5 in their respective rows, the gripper assembly 30 is lowered to transfer the full bobbins 3 to the peg support means 9. At this phase in the bobbin exchange operation, the peg support means portion P1 supports the plurality of full bobbins 3 and the peg support means portion P2 supports the plurality of empty bobbins 25. The revolution plate 40 is then revolved about its axis of revolution through 180°. This revolving movement reverses the dispositions of the peg support means portions P1, P2, namely, effects disposition of the empty bobbins 25 on the peg support means portion P2 below the gripper assembly 30 and effects disposition of the peg support means portion P1, with the full bobbins 3 supported thereon, in position for engagement by the vertical movement device 10. As the revolution plate 40 revolves through 180°, the cam follower means 48 follows the annular cam 55. Due to the offset disposition of the annular cam 55 relative to the axis of revolution of the revolution plate 40, the revolving movement of the revolution plate 40 effects laterally outward movement of the outer peg support plate 44' of the peg support means portion P2 laterally away from the associated inner peg support peg support plate 43 to thereby increase the transverse spacing of the two rows of pegs 51, 51' of the peg support means portion P2 while simultaneously effecting lateral inward movement of the outer peg support plate 44 of the peg support means portion P1 toward its associated inner peg support peg support plate 43 to thereby reduce the transverse spacing between the rows of pegs 51, 51' of the peg support means portion P1.

Once the revolution plate 40 has been revolved through 180°, the gripper assembly 30 is operated to engage the plurality of empty bobbins 25 supported on the peg support means portion P1 and, thereafter, the gripper components 5 are moved to their spacing disposition for transferring bobbins to the bobbin bank 2 and the arm means 4 is pivoted by the means 8 to position the gripper assembly 30 in its disposition for transferring the plurality of empty bobbins 25 to the bobbin bank 2. In correspondence with the exchange of the plurality of empty bobbins from the gripper assembly 30 to the bobbin bank 2, the vertical movement assembly 10 is operated to raise the peg support means portion P2 toward the creel 11 to effect transfer of the plurality of full bobbins 3 supported thereon to the rows of the creel 11.

Accordingly, the present invention provides an apparatus for adjusting both the uniform spacing between the bobbins of a row of bobbins and the transverse spacing between two parallel rows of bobbins to accommodate the differing uniform row spacings and transverse spacings of the bobbin bank of a textile fly frame and its associated creel having a supply of empty bobbins. The adjustment of the uniform spacing between the bobbins in each row is effected through selected adjustment of the gripper components of the gripper assembly and the adjustment of the transverse spacing between the two parallel rows of bobbins is effected by selected adjustment of the peg support means on the traveling service unit.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. A traveling service unit for groupwise exchange of a plurality of bobbins supported on a creel above the service unit for a plurality of bobbins supported on a bank of a fly frame, the creel having a pair of rows of pegs uniformly spaced along each row, the creel peg rows extending parallel to one another at a predetermined spacing and each peg being capable of individually supporting a bobbin thereon, the bank having a pair of rows of pegs, the bank peg rows extending parallel to one another at a predetermined spacing different than the predetermined spacing of the creel peg rows and the pegs of the bank each being capable of individually supporting a bobbin thereon and being uniformly spaced along each respective bank peg row at a uniform spacing different than the uniform spacing between the pegs in each creel peg row, comprising:

a gripper assembly including a plurality of gripper components each for releasably gripping a bobbin, the gripper components being supported relative to one another in two parallel gripper rows;

peg support means having a first portion and a second portion, each portion having two parallel rows of pegs thereon for supporting bobbins, the pegs of each row being at a uniform spacing from one another substantially equal to the uniform spacing between the pegs of each creel peg row;

gripper component spacing means for selectively adjusting the spacing of said griper components within each said gripper row relative to one another between a spacing substantially equal to the spacing of the pegs in each of said bank peg rows and in alignment for transfer of bobbins therebetween and a spacing substantially equal to the spacing between the pegs in one of said peg support means portion rows and in alignment for transfer of bobbins therebetween;

gripper moving means for selectively moving said gripper assembly between a disposition adjacent said bank for transferring bobbins between the respective gripper components and the bank and a disposition adjacent said peg support means for transferring bobbins between the respective gripper components and said peg support means;

alternately positioning means for moving said first peg support means portion between a receiving position in which it receives bobbins transferred from said gripper assembly and a lower preliminary position and for moving said second peg support means portion between said receiving position and said lower preliminary position in alternating manner with the movement of said first peg support means portion so that said first peg support means position is positioned at one of said receiving position and said lower preliminary position when said second peg support means portion is positioned at the other of said receiving position and said lower preliminary position;

means for selectively raising the respective peg support means portion positioned at said lower preliminary position to a raised position at which bobbins can be transferred between the respective raised peg support means portion and the creel and for lowering the respective raised peg support means portion from said raised position to said lower preliminary position; and peg row adjusting means for adjusting the spacing between the two parallel rows of pegs of each said first and second peg support means portion in response to movement of said peg support means portions by said alternately moving means, said peg row adjusting means being operable to adjust the spacing between said two parallel rows of one respective peg support means portion from a spacing substantially equal to the spacing between the bank peg rows to a spacing substantially equal to the spacing between the creel peg rows as the respective peg support means portion is moved from said receiving position to said lower preliminary position and to adjust the spacing between said two parallel rows of the other peg support means portion from a spacing substantially equal to the spacing between the creel peg rows to a spacing substantially equal to the spacing between the bank peg rows as the other peg support means portion is moved from said lower preliminary position to said receiving position.

2. The traveling service unit according to claim 1 and characterized further in that said gripper component spacing means adjusts the spacing of said gripper components within each said gripper row relative to one another longitudinally of said gripper row and said peg spacing adjusting means adjusts the spacing between said parallel rows of each peg support means portion transversely of said parallel rows.

3. The traveling service unit according to claim 1 and characterized further in that said alternately moving means includes means for revolving said peg support portions about an axis of revolution.

4. The traveling service unit according to claim 3 and characterized further in that said axis of revolution is a vertical axis.

5. The traveling service unit according to claim 1 and characterized further in that said gripper component spacing adjusting means includes means interconnecting each gripper component of one of said gripper rows with a corresponding gripper component of the other of said gripper rows for coordinated longitudinal movement of interconnected gripper components toward and away from each other.

6. The traveling service unit according to claim 5 and characterized further in that said interconnecting means includes an endless belt having a longitudinal reach to which one gripper component of one of said gripper rows is secured and an opposite longitudinal reach to which the corresponding gripper component of the other of said gripper rows is secured.

7. The traveling service unit according to claim 6 and characterized further by means for reciprocating the endless belt to effect movement of said gripper components toward and away from each other.

8. The traveling service unit according to claim 5 and characterized further by a longitudinal slide bar for slidably guiding said gripper components during movement of said gripper components toward and away from each other.

9. The traveling service unit according to claim 5 and characterized further in that said gripper assembly has a longitudinal midpoint and the gripper components of each interconnected pair of said gripper components is equally spaced from said longitudinal midpoint for simultaneous equal movement of the gripper components of each said interconnected pair of gripper components toward and away from each other.

10. The traveling service unit according to claim 9 and characterized further in that said interconnecting means moves the pairs of gripper components, proportionally relative to their spacing from said longitudinal midpoint to maintain equal spacing between the gripper components in each row.

11. The traveling service unit according to claim 5 and characterized further in that said interconnecting means includes a plurality of endless belts, each said endless belt having one longitudinal reach to which one gripper component in said one row of said gripper rows is secured and an opposite longitudinal reach to which the other gripper component in the other of said gripper rows is secured.

12. The traveling service unit according to claim 11 and characterized further by a plurality of means for reciprocating said endless belts to effect movement of said gripper components toward and away from each other, each said reciprocating means being connected to one of said gripper components for moving said gripper component, associated belt and corresponding gripper component to thereby effect movement of said gripper components toward and away from each other.

13. The traveling service unit according to claim 12 and characterized further in that said reciprocating means includes a cylinder and piston assembly, said piston being connected to one of said gripper components.

14. The traveling service unit according to claim 1 and characterized further in that said peg row adjusting means moves one of said parallel rows of each said peg support means portion laterally relative to the other of said parallel rows.

15. The traveling service unit according to claim 14 and characterized further in that said peg support means supports said peg support means portions in a disposition in which one row of pegs of each portion is adjacent one row of pegs of the other portion and the other row of pegs of each portion is laterally outer the adjacent row of pegs and said means for selectively adjusting the peg row spacing moves the laterally outer one of said parallel rows of each said peg support means portion relative to the other of said parallel rows.

16. The traveling service unit according to claim 14 and characterized further by slide means for supporting said laterally outer parallel row of each said peg support means portion for lateral sliding movement thereof.

17. The traveling service unit according to claim 14 characterized further by a revolution plate and means for pivotally mounting said revolution plate to the traveling service unit for rotation about an axis of revolution, the laterally inner ones of said parallel rows of said peg support means portions being supported on said revolution plate.

18. The traveling service unit according to claim 14 and characterized further in that said movable parallel rows of pegs of said peg support means portions are interconnected to one another for coordinated movement of said movable parallel rows of pegs relative to said other parallel rows of pegs of said peg support means portions.

19. The traveling service unit according to claim 18 and characterized further in that said coordinated movement interconnecting means effects movement of the movable parallel row of one peg support means portion toward the other parallel row of said one peg support means portion while simultaneously moving the movable parallel row of the other peg support means portion away from the other parallel row of said other peg support means portion.

20. The traveling service unit according to claim 1 and characterized further in that said peg support means includes a revolution plate and means for pivotally mounting said revolution plate to the traveling service unit for revolving movement of said revolution plate about an axis of revolution, means for supporting one of said parallel rows of each of said peg support means portions on said revolution plate, a pair of laterally movable plates disposed laterally outward of said revolution plate and connected thereto for revolving movement therewith, each said other row of pegs of said pairs of rows of said peg support means portions being mounted on one of said outer plates, an annular cam mounted to the traveling service unit with its axis offset from said revolution axis, cam follower means for following said annular cam, connecting link means for movably coupling said cam follower means to each of said laterally peg support plates for alternately moving each of said laterally movable plates toward and away from said revolution plate in correspondence with the cam following movement of said cam follower means along said annular cam during revolving movement of said revolution plate.

21. The traveling service unit according to claim 1 and characterized further in that each of said parallel rows of each of said peg support means portions includes three pegs, and each of said rows of gripper components includes three gripper components.

* * * * *